US006257928B1

(12) United States Patent
Murakami et al.

(10) Patent No.: US 6,257,928 B1
(45) Date of Patent: Jul. 10, 2001

(54) WATERPROOF CONNECTOR AND METHOD OF ASSEMBLING THE SAME

(75) Inventors: Takao Murakami; Masaru Fukuda, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/631,685

(22) Filed: Aug. 2, 2000

(30) Foreign Application Priority Data

Aug. 3, 1999 (JP) ..... 11-220140

(51) Int. Cl.[7] ..... H01R 13/40
(52) U.S. Cl. ..... 439/587
(58) Field of Search ..... 439/587, 589, 439/274, 275, 279

(56) References Cited

U.S. PATENT DOCUMENTS 2,332,483 * 10/1943 Dotty ..... 439/747
5,098,315 * 3/1992 Scowen ..... 439/587
5,931,699 * 8/1999 Saito ..... 439/587

FOREIGN PATENT DOCUMENTS 11-354200 12/1999 (JP) ..... H01R/13/52

* cited by examiner

*Primary Examiner*—Brian Sircus
*Assistant Examiner*—Phuong KT Dinh
(74) *Attorney, Agent, or Firm*—Sughrue, Mion, Zinn, Macpeak & Seas, PLLC

(57) ABSTRACT

A waterproof rubber plug has a through hole through which an electric wire is inserted. The electric wire is connected to a terminal. An inner housing has a terminal chamber for accommodating the terminal. An outer housing has side-walls for defining a chamber provided with a rear wall, into which the inner housing is fitted. A through hole, through which the electric wire is inserted, is formed on the rear wall so as to face the terminal chamber when the inner housing is inserted into the chamber of the outer housing. A recess is formed on the rear wall so as to communicate with the through hole and opened to the outside of the outer housing. A press-fitting member is engaged with the outer housing while press-fitting the rubber plug into the recess after the inner housing is completely fitted into the chamber of the outer housing, thereby sealing the electric wire and the terminal chamber.

3 Claims, 10 Drawing Sheets

WATERPROOF CONNECTOR AND METHOD OF ASSEMBLING THE SAME

BACKGROUND OF THE INVENTION

The present invention relates to a small size multi-way water proof connector with an improved water proof property between a connector housing and a plurality of electric wires connected with terminals, and a method of assembling the same.

A related waterproof connector disclosed in Japanese Patent Publication No. 11-354200A will be explained specifically with reference to FIGS. 8 to 10. A connector housing 11 of a water proof connector 10 comprises a synthetic resin inner housing 12 having a plurality of terminal chambers 13 formed integrally therewith, a synthetic resin outer housing 17 for fitting the inner housing 12 to the inside thereof, and a synthetic resin spacer 28 disposed between the inner housing 12 and the outer housing 17 for holding female terminals 14 accommodated in each terminal chamber 13 of the inner housing 12.

As shown in FIGS. 8 and 9, the inner housing 12 has a box part 12*a* with the rear side of the upper and lower faces opened, for forming the terminal chambers 13 in a space formed with the center horizontal wall 12*b* and vertical side walls 12*c*, serving also as partition walls in the vertical direction. The female terminals 14 can be accommodated in each terminal chamber 13. Moreover, engagement claws 15 are formed integrally, projecting from both sides and the center of the upper and lower faces of the box part 12*a* as well as flange parts 16 are formed integrally projecting from the front end of the both side center parts. Rectangular insertion holes 12*d* through which female terminals of a mating connector (not illustrated) are inserted are formed in the front wall of the box part 12*a* at a position corresponding to each terminal chamber 13. Furthermore, a pair of press-connecting blades 14*b* are formed by bending each in both side plate parts in the rear part of a box part 14*a* of the female terminals.

As shown in FIGS. 8 and 9, the outer housing 17 has a double box-like shape with the front side opened, with a substantially quadrilateral pipe-like inner wall part 17*a*, a substantially quadrilateral pipe-like outer wall part 17*b* for containing the inner wall part 17*a*, and a rear wall part 17*c*, connecting the rear parts of the inner and outer wall parts 17*a*, 17*b*. A thick portion is provided in the center of the rear wall part 17*c*. Rubber plug chambers 19 having a large diameter round cross-section for storing the water proof rubber plugs 18 by press-in are formed at a position corresponding to each terminal chamber 13 at the front side with respect to the thick portion as well as insertion holes 21 having a small diameter round cross-section for inserting electric wires 20 therethrough are formed, communicating with each corresponding rubber plug chamber 19 at the rear side with respect to the thick portion.

Moreover, rectangular engagement holes 22 to be engaged with each engagement claw 15 at both sides of the upper and lower faces of the box part 12*a* of the inner housing 12 are formed at both front sides of the upper and lower walls of the inner wall part 17*a* of the outer housing 17 as well as rectangular longitudinal engagement holes 23 to be engaged with each engagement claw 15 at the center of the upper and lower faces of the box part 12*a* of the inner housing 12 are formed at the front center portion of the upper and lower walls of the inner wall part 17*a*. Furthermore, a V-shaped receiving groove 25 for receiving an annular rubber water proof packing 24 is formed integrally, projecting from the deep part of the outer face side of the inner wall part 17*a* of the outer housing 17.

Tapered faces 26 are formed in the front rim of the inner face side of the inner wall part 17*a* of the outer housing at a position corresponding to each engagement hole 22, 23. Moreover, engagement holes 27 to be engaged with flexible engagement arms of a mating connector (not illustrated) are formed at the front side of the upper and lower walls of the outer wall part 17*b* of the outer housing 17.

As shown in FIGS. 8 and 9, the spacer 28 forms a box-like shape with the front side opened, with a substantially quadrilateral pipe-like body 28 to be fitted with the inner face side of the inner wall part 17*a* of the outer housing 17, a substantially quadrilateral pipe-like brim part 28*b* formed integrally with the front end of the body 28*a*, bent rearward therefrom, to be fitted with the outer face side of the inner wall part 17*a* of the outer housing, and a rear wall part 28*c* of the body 28*a*.

Accordingly, the box part 12*a* of the inner housing 12 can be fitted into the body 28*a* of the spacer 28. Rib-like projections 29 for preventing fall-off of the terminals are formed integrally, projecting from the inner face of the upper and lower walls of the body 28*a* of the spacer 28, to be engaged with the rear end rim of the box part 14*a* of the female terminals 14 accommodated in each terminal chamber 13.

Moreover, notch portions 30, 31 are formed in the front side of the portion connecting the body 28*a* and the brim part 28*b* of the spacer 28 at a position corresponding to each of the engagement claw 15 and the flange part 16 of the inner housing 12. Engagement claws 32 to be engaged with each engagement hole 23 of the outer housing 17 are formed integrally, projecting form the outer face side of the upper and lower walls of the body 28*a* of the spacer 28 between the upper and lower side notch portions 30. Furthermore, the tip portion of the brim part 28*b* can hold the packing 24 engaged with the receiving groove 25 of the inner wall part 17*a* of the outer housing 17 when the fitting operation with respect to the outer housing 17 is completed.

Moreover, insertion holes 33 are formed in the rear wall part 28*c* of the spacer 28 at a position corresponding to each insertion hole 21 of the outer housing 17. Furthermore, the rear wall part 28*c* of the spacer 28 can hold the rubber plugs 18 inserted in each rubber plug chamber 19 of the rear wall part 17*c* of the outer housing when the fitting operation with respect to the outer housing 17 is completed. As shown in FIG. 8, each electric wire 20 inserted through each insertion hole 21 of the outer housing 17, each rubber plug 18 and each insertion hole 33 of the spacer 28 is press-connected between the pair of the press-connecting blades 14*b*, 14*b* of each female terminal accommodated in each terminal chamber 13 of the inner housing 12 so that each terminal chamber 13 and each electric wire 20 are sealed with the rubber plug 18 and the packing 24, respectively.

A conical face (tapered face) 19*a* is formed at the inlet of each of the rubber plug chambers 19 formed in the rear wall part 17*c* of the outer housing 17. Conical faces (tapered faces) 28*d*, each serving also as a rubber compressor, are formed in the outer face of the rear wall part 28*c* of the spacer 28, and are formed around the wire insertion holes 33, respectively. Before the rubber plugs 18 are inserted respectively into the rubber plug chambers 19 in the outer housing 17 (that is, in a provisional engagement state (FIG. 8) in which the front portion of the body 28*a* of the spacer 28 is fitted in the inner wall part 17*a* of the outer housing 17), each rubber plug 18 is held between the conical face 19*a* of the associated rubber plug chamber 19 and the conical face 28*d* around the associated wire insertion hole 33 in the spacer 28.

As shown in FIG. 8, conical faces (tapered faces) 18*a* are formed respectively at the opposite ends of the rubber plug 18 through which the electric wire 20 is passed. The inner diameter Rb of the rubber plug 18 (that is, the diameter of a wire insertion hole 18*b* in the rubber plug 18) is equal to or larger than the diameter R of the electric wire 20 ($Rb \geqq R$). The outer diameter Ra of the rubber plug 18 is larger than the diameter D of the rubber plug chamber 19, and the sealing configuration ($Ra-Rb+R>D$) is established in the rubber plug chamber 19.

The waterproof rubber plug 18 have a substantially cylindrical shape with the rugged inner and outer circumferential faces so that the electric wires 20 can be inserted through the inside thereof without having a gap.

For assembling the waterproof connector 10 of the above construction, the packing 24 is beforehand inserted and set in the receiving groove 25 on the inner wall part 17*a* of the outer housing 17 (which forms the outer part of the connector housing 11). Then, the electric wires 20 are passed respectively through the plurality of wire insertion holes 21 in the rear wall part 17*c* of the outer housing 17 from the outside thereof. Then, the electric wires 20 are passed through the rubber plugs 18, respectively, and then are passed respectively through the wire insertion holes 33 in the rear wall part 28*c* of the spacer 28 from the outside thereof.

Then, as shown in FIG. 6, each rubber plug 18 is not inserted into the associated rubber plug chamber 19 in the rear wall part 17*c* of the outer housing 17, but the front portion of the body 28*a* of the spacer 28 is fitted in the inner wall part 17*a* of the outer housing 17 (that is, disposed in the provisional engagement state), so that each rubber plug 18 is held between the conical face 19*a* of the associated rubber plug chamber 19 and the conical face 28*d* around the associated wire insertion hole 33 in the rear wall part 28*c* of the spacer 28. Then, each electric wire 20 is press-connected to the pairs of press-connecting blades 14*b* of the female terminal 14 received in the associated terminal chamber 13 in the inner housing 12 (which forms the inner part of the connector housing 11).

Then, the inner housing 12 is fitted into the body 28*a* of the spacer 28 while sliding the electric wires 20 relative to the wire insertion holes 33 in the rear wall part 28*c* of the spacer 28 and the wire insertion holes 21 in the rear wall part 17*c* of the outer housing 17, and the body 28*a* of the spacer 28 is completely fitted into the inner wall part 17*a* of the outer housing 17 to be held in a complete engagement state. As a result, the conical face 28*d* around each wire insertion hole 33 in the rear wall part 28*c* of the spacer 28 forces the rubber plug 18 into the associated rubber plug chamber 19, thus completing the assembling of the waterproof connector 10 in which the electric wires 20 are sealed by the rubber plugs 18, respectively. During the time when the inner housing 12 is fitted into the spacer 28 fitted in the provisional engagement state in the outer housing 17 through the rubber plugs 18, the insertion of the inner housing 12 is not substantially resisted by the rubber plugs 18, and therefore the waterproof connector 10 can be smoothly assembled without buckling the electric wires 20, and the efficiency of the overall assembling operation is further enhanced.

In the above related waterproof connector 10, as shown in FIG. 6, each electric wire 20 is passed through the rubber plug 18 held in a stand-by state (that is, not yet received in the associated rubber plug chamber 19), and then the distal end portion of the electric wire 20 is press-connected to the female terminal 14 received in the terminal chamber 13 in the inner housing 12, and then the inner housing 12 is inserted and completely retained in the outer housing 17 through the spacer 28 while slidingly moving the electric wires 20 respectively through the wire insertion holes 18*b* of the rubber plugs 18, so that the rubber plugs 18 are forced into the rubber plug chambers 19, respectively. Thus, the assembling operation is effected while slidingly moving the electric wires 20 relative to the rubber plugs 18, respectively. Therefore, in the case where the number of rubber plugs 18 is large, a total frictional force, produced by the sliding movement of the electric wires 20 relative to the rubber plugs 18, increases, and a load, required for fitting the inner housing 12 into the outer housing 17, increases, which results in a possibility that the production of an electric wire harness is affected. Namely, in the case where the number of rubber plugs 18 is large, the operating load (the rubber plug-inserting load and the housing-fitting load) due to the sliding friction between the rubber plugs 18 and the electric wires 20 increases during the operation for fitting the inner housing 12 into the outer housing 17 through the spacer 28, and this has resulted in a possibility that the efficiency of the assembling operation of the waterproof connector 10 is lowered.

Furthermore, since the rubber plugs 18 are not certainly accommodated in the rubber plug chambers 19 due to the worse efficiency of the assembling operation, the rubber plugs 18 sometimes fall out of the rubber plug chambers 19 after the waterproof connector 11 has been assembled. Under such a circumstance, the waterproof connector does not work because water or the like invades into the connector housing from the portion where the rubber plug has fallen out.

SUMMARY OF THE INVENTION

The present invention has been made in order to solve the above problems, and an object of the invention is to provide a multi-way waterproof connector of a small size, as well as a method of assembling the waterproof connector, in which the efficiency of an assembling operation is enhanced, and to provide a multi-way waterproof connector capable of certainly preventing the rubber plugs from falling out of the rubber plug chamber after the waterproof connector has been assembled.

In order to achieve the above objects, according to the present invention, there is provided a waterproof connector comprising:

- a waterproof rubber plug having a through hole through which an electric wire is inserted;
- a terminal to which the electric wire is connected;
- an inner housing having a terminal chamber for accommodating the terminal;
- an outer housing having sidewalls for defining a chamber provided with a rear wall, into which the inner housing is fitted;
- a through hole, through which the electric wire is inserted, formed on the rear wall so as to face the terminal chamber when the inner housing is inserted into the chamber of the outer housing;
- a recess formed on the rear wall so as to communicate with the through hole and opened to the outside of the outer housing; and
- a press-fitting member engaged with the outer housing while press-fitting the rubber plug into the recess after the inner housing is completely fitted into the chamber of the outer housing, thereby sealing the electric wire and the terminal chamber.

In this case, since the press-fitting member is engaged with the outer housing to serve as a rear cover of the waterproof connector after the rubber plug has been press-fit into the rubber plug chamber, the rubber plug is certainly prevented from falling out of the rubber plug chamber.

Preferably, a hook member is formed an inner wall of the recess for retaining the rubber plug inside of the recess.

In this case, the rubber plug is further certainly prevented from falling out of the rubber plug chamber.

According to the present invention, there is also provided an assembling method for the above waterproof connector comprising the steps of:

passing the electric wire through the through hole of the rubber plug;

passing the electric wire through the through hole on the rear wall of the outer housing while staying the rubber plug outside of the outer housing;

connecting the electric wire to the terminal;

fitting the terminal into the terminal chamber of the inner housing;

fitting the inner housing into the chamber of the outer housing; and fitting the rubber plug into the recess of the outer housing by engaging the press-fitting member with the outer housing.

In this case, when passing the electric wire through the associated insertion hole in the outer housing and when fitting the inner housing into the outer housing, the electric wire is in a free state, that is, not slid relative to the associated rubber plug, and therefore the electric wire can be smoothly set without being buckled, and the operating load, that is, the electric wire inserting force and the housing fitting force, is reduced.

Furthermore, even if a large number of electric wires and associated rubber plugs are provided, since the rubber plugs are press-fit into the associated rubber plug chambers all together by the press-fitting member, the rubber plugs can be easily inserted into the respective rubber plug chambers in the outer housing in a short time, so that the efficiency of the assembling operation of the waterproof connector can be further enhanced.

Preferably, the press-fitting member is a leverage member one end of which is pivotably supported on the outer housing, and the other end of which is engaged with the outer housing while press-fitting the rubber plug into the recess by the leverage action thereof.

In this case, since the rubber plugs can be easily inserted respectively into the rubber plug chambers by the leverage member with a small operating force, the efficiency of the overall assembling operation of the waterproof connector is enhanced.

DETAILED DESCRIPTION OF THE PREFERRED EMBODIMENTS

Preferred embodiment of the present invention will now be described with reference to the drawings.

Figure 1:
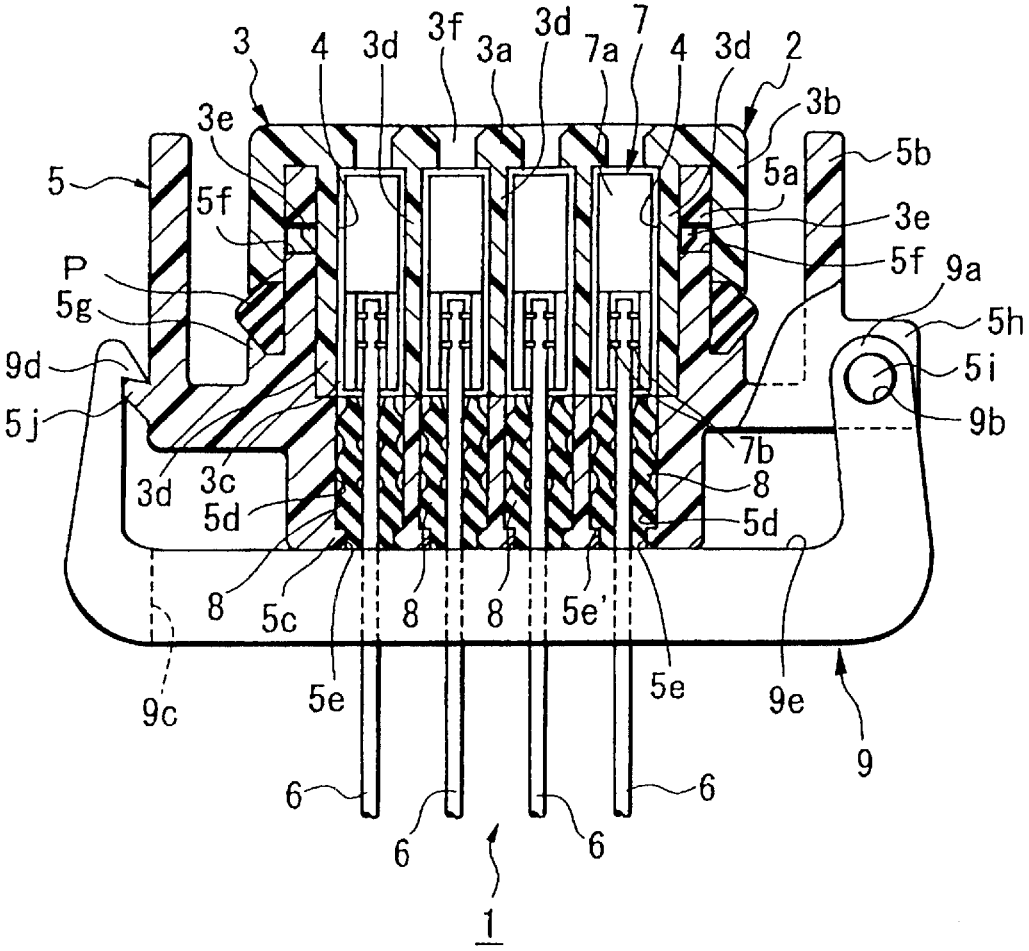
FIG. 1 is a cross-sectional view of a waterproof connector according to a first embodiment of the invention, showing an assembled state.
Figure 2:
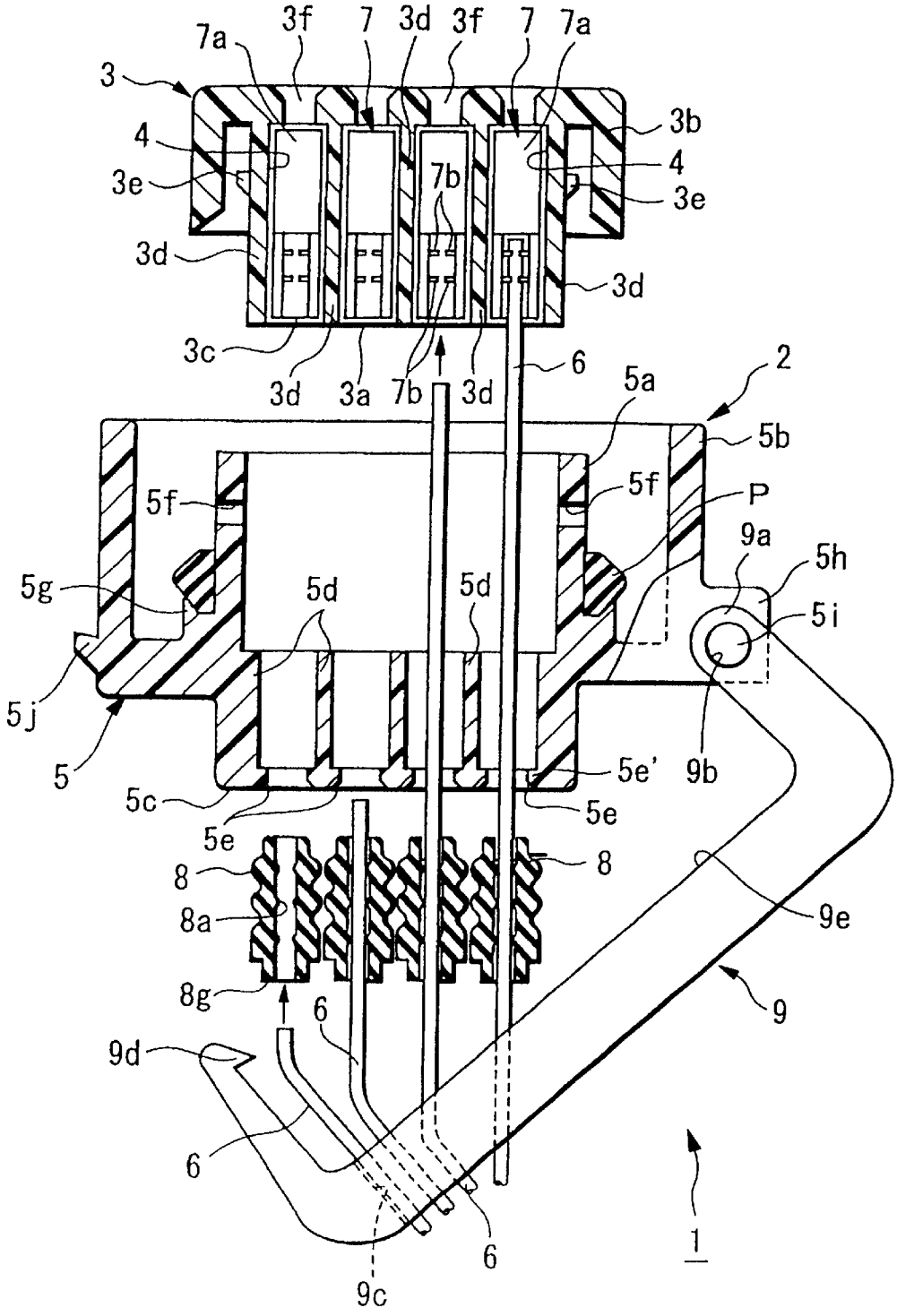
FIG. 2 is a cross-sectional view of the waterproof connector of FIG. 1, showing a state before an inner housing is fitted into an outer housing.
Figure 3:
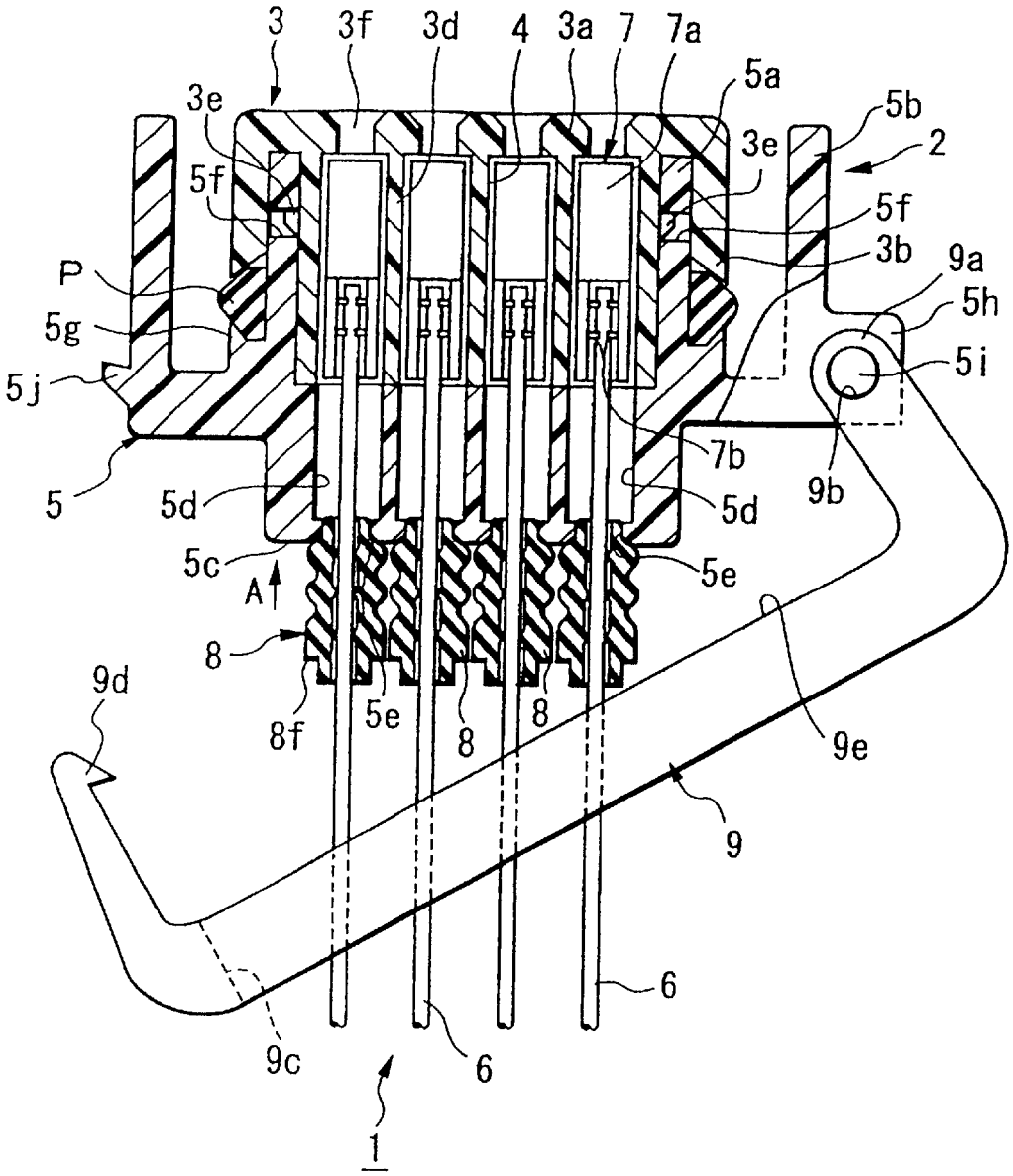
FIG. 3 is a cross-sectional view of the waterproof connector of FIG. 1, showing a state before rubber plugs are inserted respectively into rubber plug chambers in the outer housing.
Figure 4:
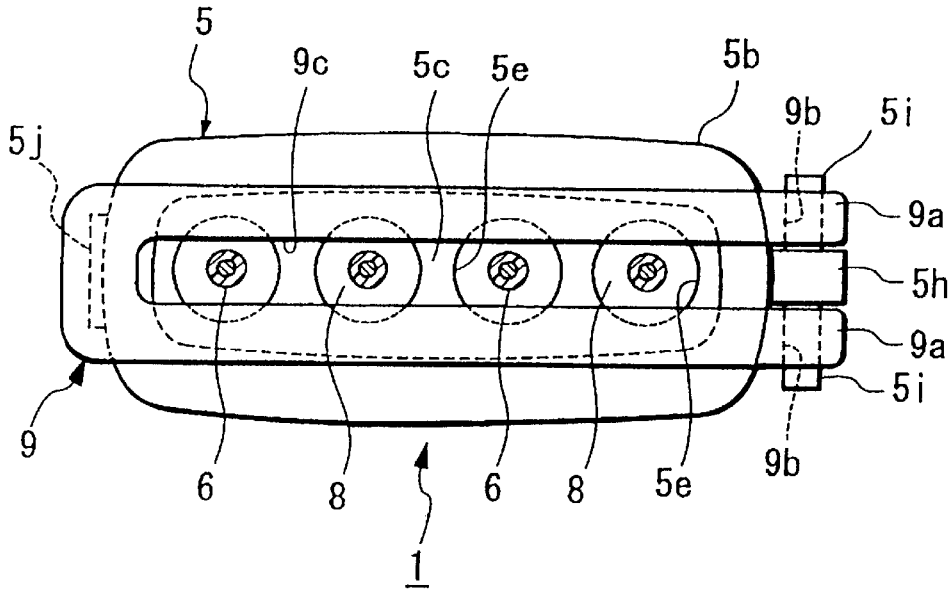
FIG. 4 is a rear side view of the waterproof connector of FIG. 1.
Figure 5A:
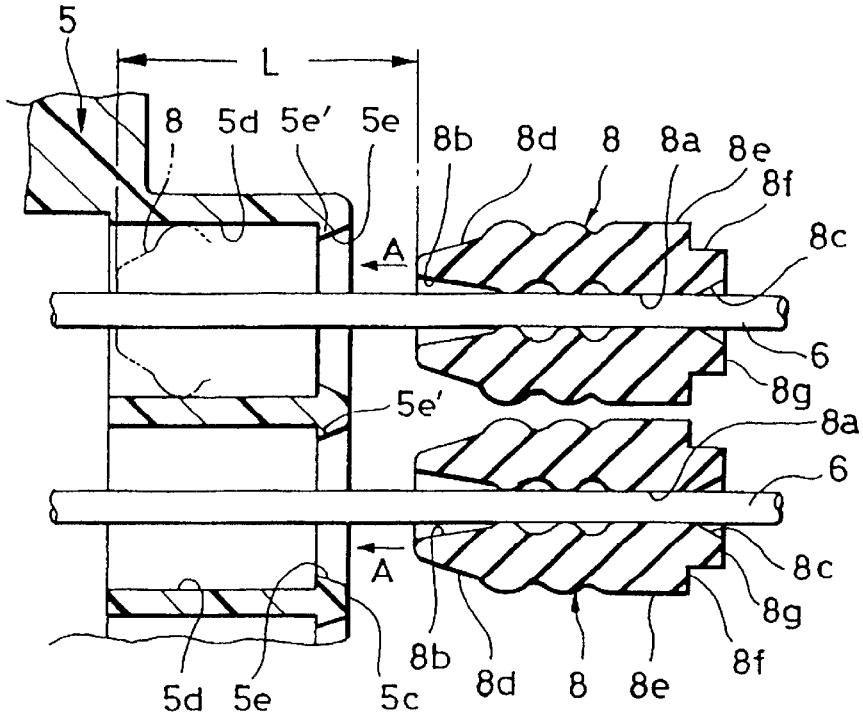
FIG. 5A is a fragmentary, cross-sectional view showing a state before the rubber plugs are inserted into the rubber plug chambers, respectively.
Figure 5B:
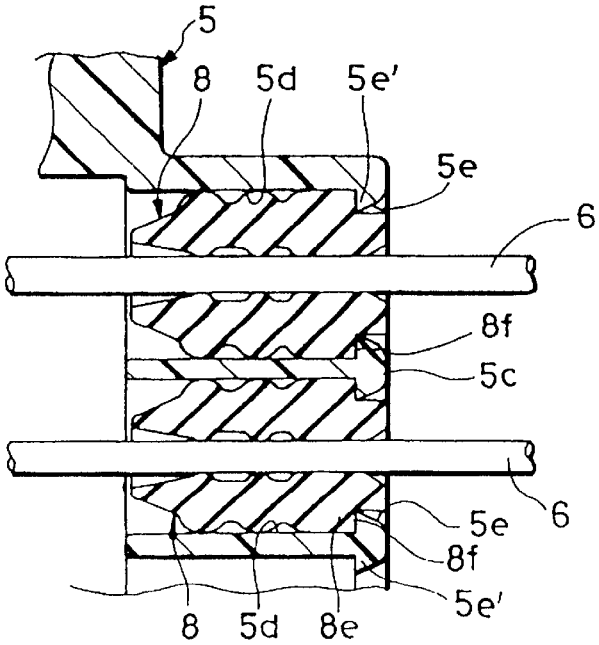
FIG. 5B is a fragmentary cross-sectional view showing a state in which the rubber plugs are received in the rubber plug chambers, respectively.

FIG. 1 is a cross-sectional view of a waterproof connector according to a first embodiment of the invention, showing an assembled state. FIG. 2 is a cross-sectional view of the waterproof connector showing a state before an inner housing is fitted into an outer housing. FIG. 3 is a cross-sectional view of the waterproof connector, showing a state before rubber plugs are inserted respectively into rubber plug chambers in the outer housing. FIG. 4 is a rear side view of the waterproof connector. FIG. 5A is a fragmentary, cross-sectional view showing a state before the rubber plugs are inserted into the rubber plug chambers, respectively. FIG. 5B is a fragmentary cross-sectional view showing a state in which the rubber plugs are received in the rubber plug chambers, respectively.

As shown in FIGS. 1 to 3, a connector housing 2 of the waterproof connector 1 includes the inner housing 3, which is integrally molded of a synthetic resin, and has a plurality of terminal chambers 4, and the outer housing 5 of a synthetic resin in which the inner housing 3 is fitted.

The inner housing 3 includes a box-like body 3*a*, which is open at a rear portion of an upper side thereof, and is adapted to fit in an inner wall part 5*a* of the outer housing 5, and a flange part 3*b* of a substantially square tubular shape which is integrally formed on and extends in a folded-back manner rearwardly from a front end of the body 3*a*, and is adapted to fit on the inner wall part 5*a* of the outer housing 5. The terminal chambers 4 are formed by a central horizontal wall 3*c* and vertical side walls (serving as partition walls) 3*d* of the body 3*a*. Female terminals 7 to be connected respectively to electric wires 6 are received in these terminal chambers 4, respectively.

Retaining pawls 3*e* are formed respectively on central portions of opposite side faces of the body 3*a* of the inner housing 3, and these retaining pawls 3*e* are releasably engaged respectively in retaining holes 5*f* formed in the outer housing 5 (described later). Rear end faces of the vertical side walls 3*d* of the body 3*a* of the inner housing 3 retain the rubber plugs 8 inserted respectively in the rubber plug chambers 5*d* in a rear wall part 5*c* of the outer housing 5 when the inner housing 3 is completely fitted in the outer housing 5.

A distal end of the flange part 3*b* of the inner housing 3 holds a packing P, retained by a receiving groove 5*g* on the inner wall part 5*a* of the outer housing 5, when the inner housing 3 is completely fitted in the outer housing 5. Insertion holes 3*f* of a rectangular shape are formed respectively through those portions of a front wall of the body 3*a* opposed respectively to the terminal chambers 4, and male terminals in a mating connector (not shown) are passed through these insertion holes 3*f*, respectively. Two pairs of press-connecting blades 7*b* are formed by stamping on opposite side walls of a box-like portion 7*a* of the female terminal 7 at a rear portion thereof.

The outer housing 5 includes the inner wall part 5*a* and of a square tubular-like outer wall part 5*b* formed around the inner wall part 5*a*, and the rear wall part 5*c* interconnecting rear end portions of the inner and outer wall parts 5*a* and 5*b*. Thus, the outer housing 5 has a double-box construction having an open front side. A central portion of the rear wall part 5*c* is thickened, and the rubber plug chambers or recesses 5*d* of a circular cross-section with a large diameter are formed respectively in those portions of an inner face of this thickened portion opposed respectively to the terminal chambers 4, and the waterproof rubber plugs 8 are inserted respectively into these rubber plug chambers 5*d* by press-fitting or the like. Circular wire insertion holes 5*e* are formed in the outer face of the thickened portion, and communicate with the rubber plug chambers 5*d*, respectively, and the electric wires 6 are passed through the wire insertion holes 5*e*, respectively.

The rectangular retaining holes 5*f* are formed respectively in opposite side portions of a front portion of the inner wall part 5*a* of the outer housing 5, and the retaining pawls 3*e*, formed respectively on the opposite side faces of the body 3*a* of the inner housing 3, are releasably engaged in these retaining holes 5*f*, respectively. The receiving groove 5*g* having a V-shaped cross-section is integrally formed in a projected manner on the outer face of the inner wall part 5*a* of the outer housing 5 at the inner end portion thereof, and the annular waterproof packing P of rubber is held by this receiving groove 5*g*. The wire insertion holes 5*e*, which are formed in the rear wall part 5*c* of the outer housing 5, and are aligned respectively with the rubber plug chambers 5*d* formed in the rear wall part 5*c*, are larger in diameter than the wire insertion holes 33 formed in the rear wall part 28*c* of the spacer 28 of the above-mentioned related construction. A conical tapered face is formed at an inlet of each wire insertion hole 5*e* through which the electric wire 6 is introduced into the outer housing 5, and a hook portion 5*e'* is formed on the inner face of this inlet portion in an overhanging manner over an entire circumference thereof. With this construction, after the inner housing 3 is fitted into the inner wall part 5*a* of the outer housing 5, the rubber plugs 8 can be inserted respectively into the rubber plug chambers 5*d* in the outer housing 5 from the outside thereof in a direction of arrow A as shown in FIGS. 3, 5A and 5B.

As shown in FIGS. 5A and 5B, each of the rubber plugs 8 has a wire insertion hole 8*a* through which the electric wire 6 is passed, and conical tapered faces 8*b* and 8*c* are formed at opposite ends of this wire insertion hole 8*a*, respectively. An inner face of the wire insertion hole 8*a* (which is an inner peripheral face of the rubber plug 8) and an outer peripheral face of the rubber plug 8 are corrugated; and the electric wire is passed through the wire insertion hole 8*a* in a closely-fitted manner. A conical face (tapered face) 8*d* is formed on the outer peripheral face of the rubber plug 8 at the front end portion thereof, and therefore the rubber plug 8 can be easily inserted into the rubber plug chamber 5*d*. A stepped portion 8*f* is annularly formed in the outer peripheral face of the rubber plug 8 at the rear end thereof, that is, at a rear end of a shoulder portion 8*e*. When the rubber plug 8 is received in the rubber plug chamber 5*d* in the outer housing 5, the hook portion 5*e'*, formed on the inner face of the wire insertion hole 5*e*, bites into the stepped portion 8*f* of the rubber plug 8, thereby retaining the rubber plug 8, as shown in FIGS. 1 and 5B.

As shown in FIGS. 1 to 3, when the rubber plugs 8 are to be inserted respectively into the rubber plug chambers 5*d* in the outer housing 5 from the outside in the direction of arrow A, the rubber plugs 8 are sequentially pressed and inserted into the respective rubber plug chambers 5*d* by an insertion lever (press-fitting member) 9 pivotally movable about support shafts 5*i*. More specifically, a horizontal flange 5*h* of a substantially rectangular shape is formed integrally on one side face of the outer wall part 5*b* of the outer housing 5. The pair of cylindrical support shafts 5*i* are formed integrally on upper and lower faces of the flange 5*h*, respectively, and extend vertically, and the insertion lever 9 is pivotally supported by these support shafts 5*i*.

The insertion lever 9 is made of a synthetic resin, and assumes a U-shape in its front-elevational view and its plan view. Circular engagement holes 9*b* are formed respectively through a pair of proximal end portions 9*a* of the insertion lever 9, and the two support shafts 5*i* are rotatably fitted in these engagement holes 9*b*, respectively. Therefore, the insertion lever 9 is pivotally movable about the pair of support shafts 5*i* on the outer housing 5. As shown in FIG. 4, a space 9*c* is formed in the insertion lever 9 through which the electric wires are inserted. A distal end 9*d* of the insertion lever. 9 is formed into a hook shape (substantially V-shape), and this hook-shaped distal end 9*d* is releasably engaged with a retaining projection 5*j* formed integrally on the other side face of the outer wall part 5*b* of the outer housing 5.

For assembling the waterproof connector 1 of this embodiment, the packing P is beforehand inserted and set in the receiving groove 5*g* on the inner wall part 5*a* of the outer housing 5 (which forms the outer part of the connector housing 2). Also, the electric wires 6 are beforehand passed respectively through the rubber plugs 8 disposed outside the rear wall part 5*c* of the outer housing 5, as shown in FIG. 2. Then, the electric wires 6 are passed respectively through the plurality of wire insertion holes 5*e* in the rear wall part 5*c* of the outer housing 5 from the outside thereof.

Then, as shown in FIG. 2, each electric wire 6 is press-connected to the pairs of press-connecting blades 7*b* of the terminal 7 received in the associated terminal chamber 4 in the inner housing 3 (which forms the inner part of the connector housing 2). Then, the electric wires 6 are pulled in a direction toward the outside of the outer housing 5, and are slid relative to the respective wire insertion holes 5*e* in the rear wail part 5*c* of the outer housing 5, so that the inner housing 3 is fitted into the inner wall part 5*a* of the outer housing 5, as shown in FIG. 3. This fitted state is maintained by the retaining engagement of the retaining pawls 3*e* (formed on the body 3*a* of the inner housing 3) in the respective retaining holes 5*f* in the inner wall part 5*a* of the outer housing 5.

Then, the rubber plugs 8 are pressed by the insertion lever 9 to move along the respective electric wires 6, and therefore are inserted into the respective rubber plug chambers 5*d* in the rear wall part 5*c* of the outer housing 5 from the outside of the outer housing 5 in the direction of arrow A, and the distal end 9*d* of the insertion lever 9 is retainingly engaged with the retaining projection 5*j* on the outer wall part 5*b* of the outer housing 5 so as to serve a rear cover of the connector housing 2, as shown in FIG. 1. Thus, the assembling of the waterproof connector 1 is completed. When the rubber plugs 8 are to be pressed and inserted respectively into the rubber plug chambers 5*d* in the outer housing 5 from the outside, the distance L of sliding movement of each rubber plug 8 relative to the electric wire 6 is short as shown in FIG. 5A, and therefore the electric wire 6 is less liable to be buckled, so that the efficiency of the assembling operation of the waterproof connector 1 can be enhanced. And besides, as shown in FIGS. 1 and 5B, each rubber plug 8, received in the associated rubber plug chamber 5*d* in the outer housing 5, is retained by the hook portion 5*e'*, formed on the inner face of the associated wire insertion hole 5*e* in the outer housing 5, and is also retained by the insertion lever 9 retainingly engaged with the retaining projection 5*j* on the outer wall part 5*b* of the outer housing 5. Therefore, the rubber plug 8 will not be fallen out of the rubber plug chamber 5*d* in the outer housing 5.

Thus, after the inner housing 3 is fitted into the outer housing 5, the rubber plugs 8 are inserted respectively into the rubber plug chambers 5*d* from the outside thereof, and these rubber plugs 8 are retained by the insertion lever 9. Therefore, when passing each electric wire 6 through the wire insertion hole 5*e* in the outer housing 5 and when fitting the inner housing 3 into the outer housing 5, each electric wire 6 is in a free state, that is, not slid relative to the associated rubber plug 8, and therefore the electric wire 6 can be smoothly set without being buckled, and the operating load, that is, the electric wire inserting force and the housing fitting force, can be greatly reduced. Therefore, the multi-way waterproof connector 1 of an excellent waterproof nature can be easily assembled in a short time. Namely, an electric wire harness, comprising a bundle of electric wires 6, can be easily produced, and the efficiency of the overall assembling operation is further enhanced.

Since the insertion lever 9 is provided on the rear wall part 5*c* of the outer housing 5 so as to retain the inserted rubber plugs 8 respectively inserted into the rubber plug chambers 5*d* by insertion leverage of this insertion lever 9, the rubber plugs 8 are prevented from falling out of the rubber plug chambers 5*d* in the outer housing 5. Further, as shown in FIGS. 1 and 3, since rear end faces 8*g* of the plurality of rubber plugs 8, juxtaposed in a horizontal direction, are sequentially pressed by a pressing face (inner face) 9*e* of the insertion lever 9 with a small operating force, the rubber plugs 8 can be easily inserted into the respective rubber plug chambers 5*d* in the outer housing 5 in a short time, so that the efficiency of the assembling operation of the waterproof connector 1 can be further enhanced.

And besides, each rubber plug 8, received in the associated rubber plug chamber 5*d* in the outer housing 5, is retained by the hook portion 5*e'*, formed on the inner face of the associated wire insertion hole 5*e* in the outer housing 5, and the pressing face 9*e* of the insertion lever 9 retainingly engaged with the retaining projection 5*j* on the outer wall part 5*b* of the outer housing 5. Thus, the double-retaining of the rubber plugs 8 is achieved, and therefore each rubber plug 8 is positively prevented from withdrawal from the associated rubber plug chamber 5*d* in the outer housing 5.

Figure 6:
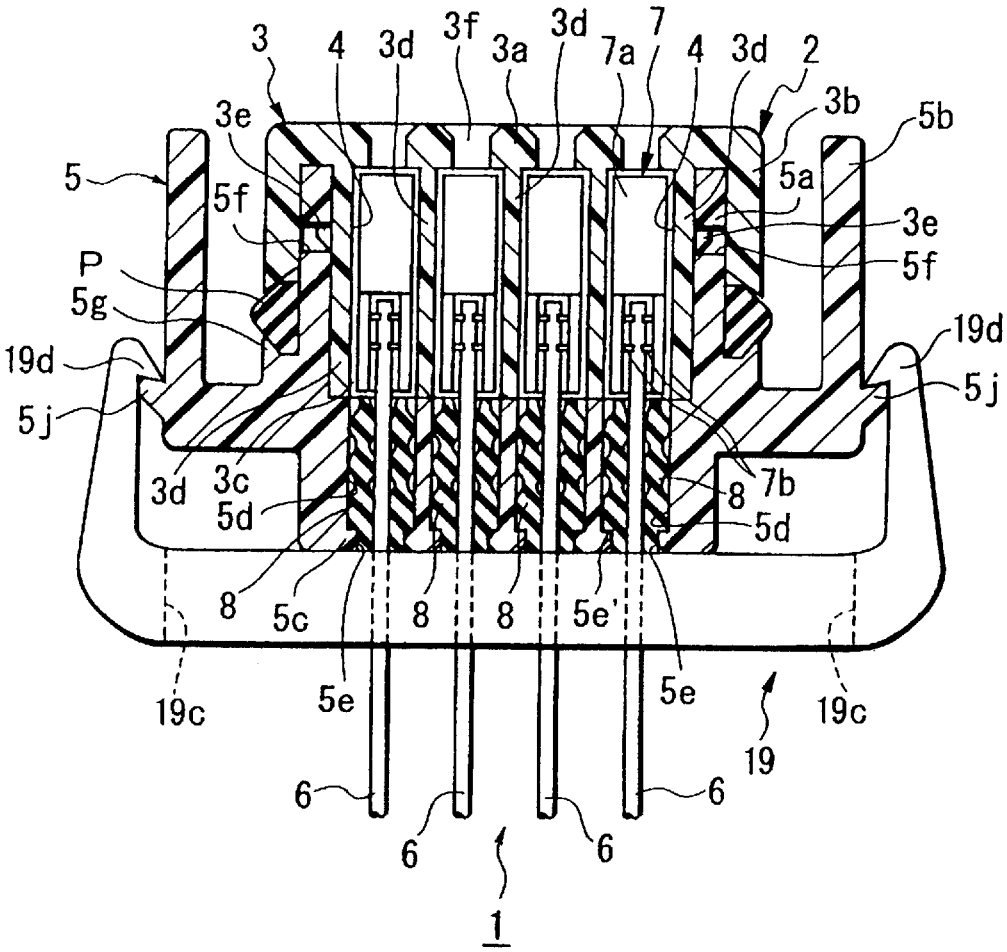
FIG. 6 is a cross-sectional view of a waterproof connector according to a second embodiment of the invention, showing an assembled state.
Figure 7:
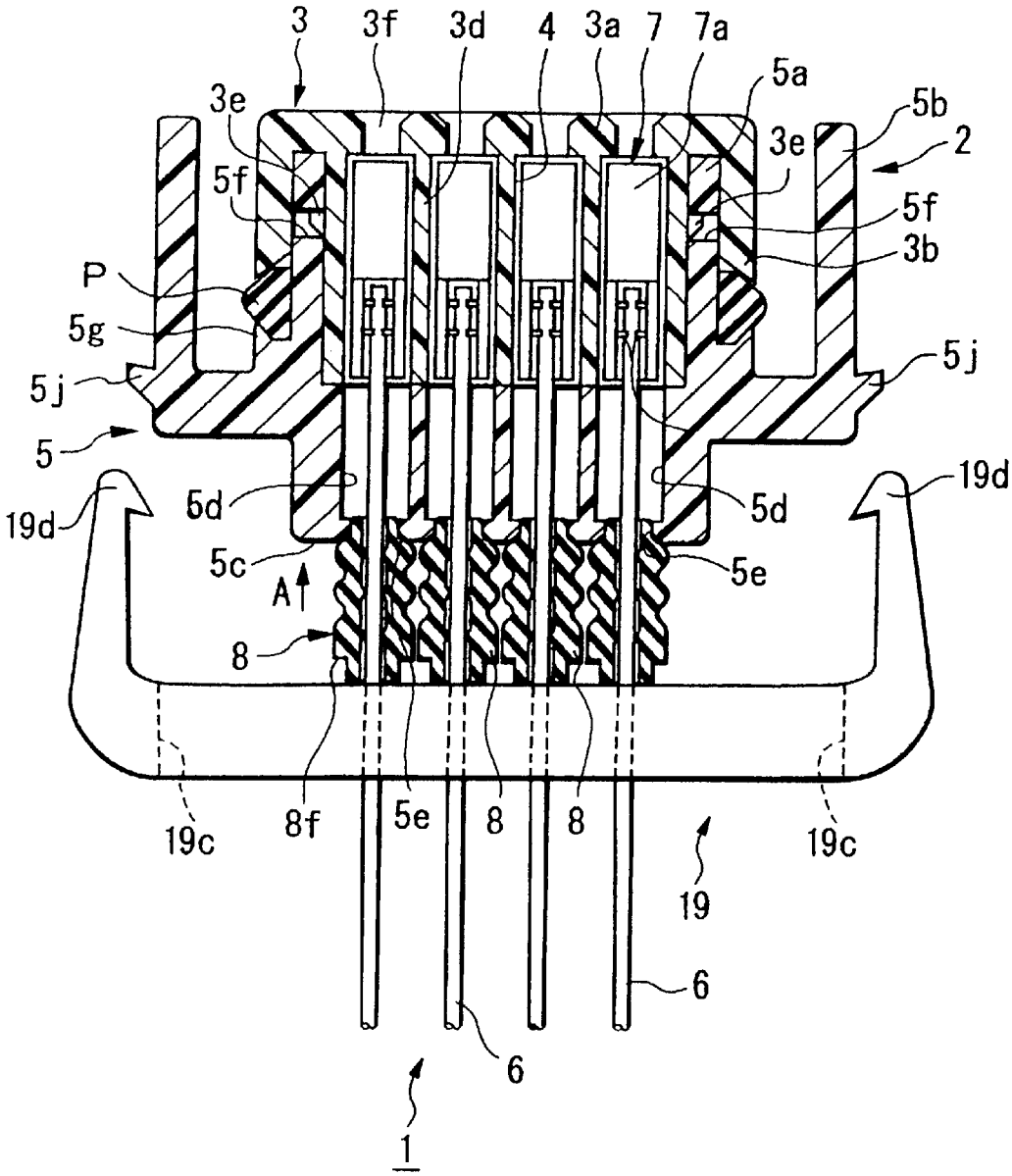
FIG. 7 is a cross-sectional view of the waterproof connector of FIG. 6, showing a state before rubber plugs are inserted respectively into rubber plug chambers in an outer housing.
Figure 8:
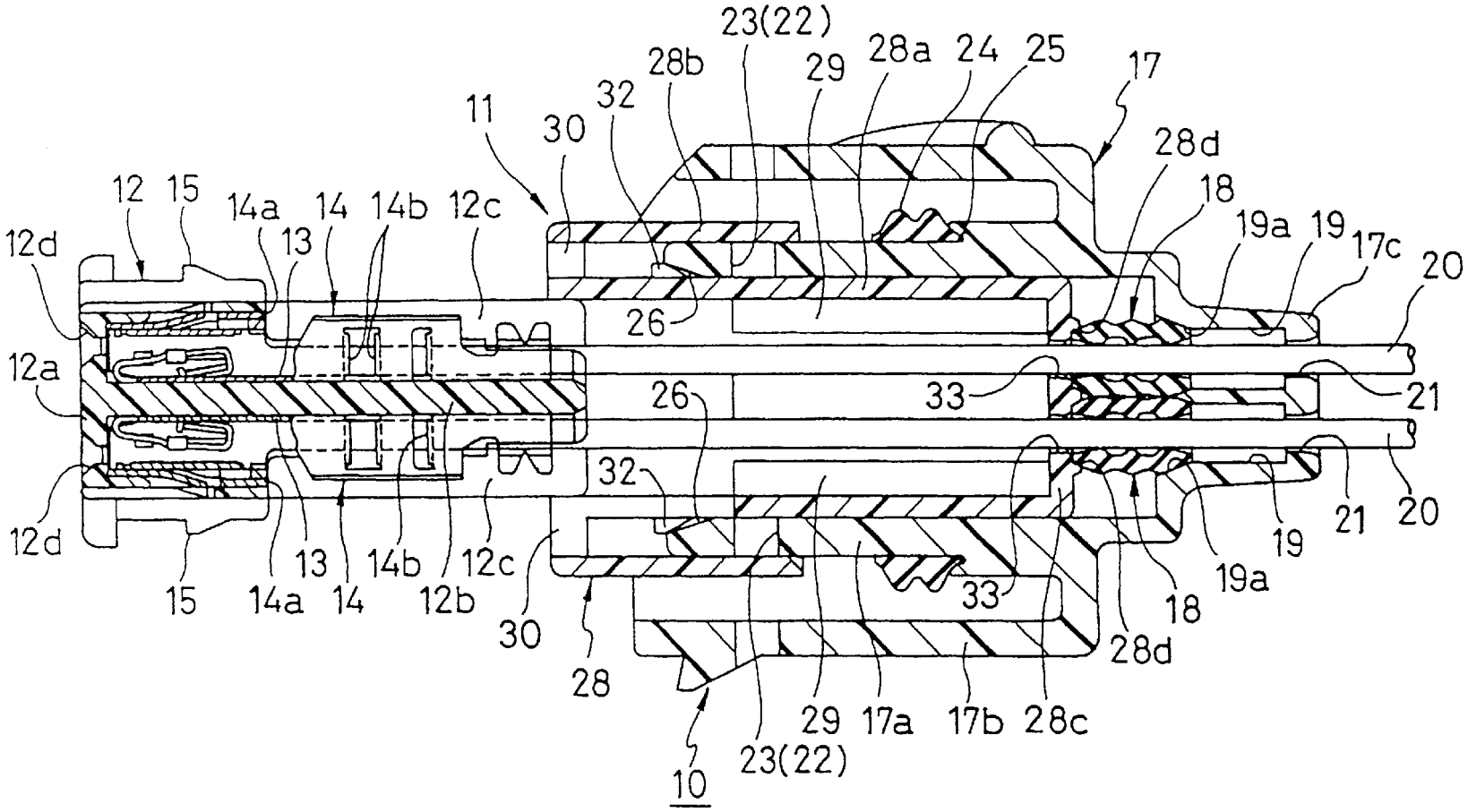
FIG. 8 is a cross-sectional view of a related waterproof connector, showing a state in which an outer housing and a spacer are provisionally engaged with each other.
Figure 9:
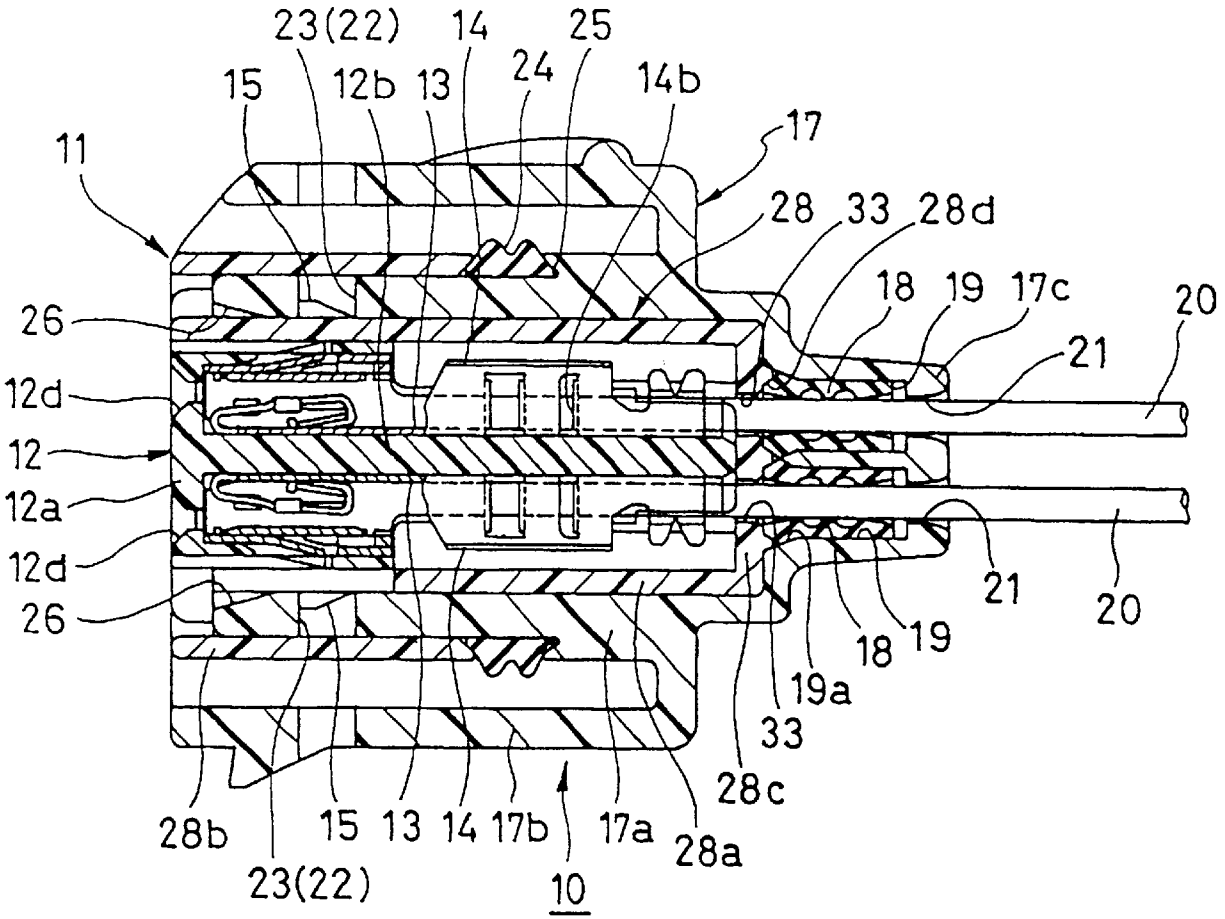
FIG. 9 is a cross-sectional view of the related waterproof connector, showing a state in which the outer housing and the spacer are completely engaged with each other.
Figure 10:
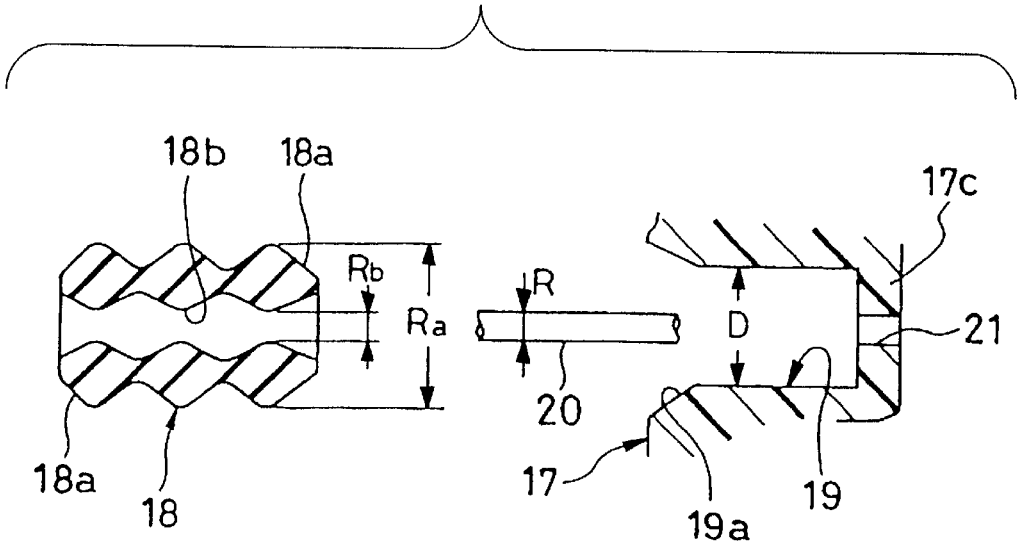
FIG. 10 is an enlarged, explanatory view of an essential portion of the related waterproof connector.

Next, a waterproof connector according to a second embodiment of the present invention will be described with reference to FIGS. 6 and 7. FIG. 6 is a cross-sectional view showing an assembled state. FIG. 7 is a cross-sectional view showing a state before rubber plugs are inserted respectively into rubber plug chambers in an outer housing.

As shown in FIGS. 6 and 7, the waterproof connector 1' of this embodiment is differs from the waterproof connector 1 of the first embodiment in the point that a pair of retaining projections 5*j* are formed integrally on side faces of an outer wall part 5*b* of an outer housing 5, and that the press-fitting member is provided as a separate cover member 19 in which a pair of hook-like retaining members 19*d* to be releasably engaged with the retaining projections 5*j* respectively are formed on both side end portions thereof. Same reference numerals are assigned to other members identical with those of the waterproof connector of the first embodiment, and detailed -explanation for those are omitted.

For assembling the waterproof connector 1', as shown in FIG. 7, electric wires 6 are inserted through an insertion hole 19*c* formed in the cover member 19 after fitting an inner housing 3 into an inner wall part 5*a* of the outer housing 5 as well as the first embodiment. Next, the cover member 19 is pressed toward the outer housing 5 in a direction indicated by an arrow A in order to press-fit rubber plugs 8 into rubber plug chamber 5*d* of the outer housing 5. After then, the retaining members 19*d* of the cover member 19 are respectively engaged with- the retaining projections 5*j* to complete the assembling of the waterproof connector 1'. At this time, the cover member 19 serves as a rear cover for preventing the press-fit rubber plugs 8 from falling out of the rubber plug-chamber 5*d*.

According to the waterproof connector 1', similar advantageous effect as well in the first embodiment can be obtained. Namely, since it is configured that the rubber plugs 8 are press-fit into the rubber plug chambers 5*d* all together by the cover member 19 after the inner housing 3 are fitted with the outer housing 5, the rubber plugs 8 can be easily inserted into the respective rubber plug chambers 5*d* in the outer housing 5 in a short time, so that the efficiency of the assembling operation of the waterproof connector 1' can be further enhanced.

In addition, since the cover member 19 is engaged with the outer housing 5 to serve as a rear cover of the waterproof connector 1' after the rubber plugs 8 have been press-fit into the respective rubber plug chambers 5*d*, the rubber plugs 8 are certainly prevented from falling out of the respective rubber plug chambers 5*d*. Further, comparing with the first embodiment in which the insertion lever 9 have to be pivotably attached onto the outer housing 5, each member can be provided with simple configuration, thereby the manufacturing cost can be remarkably reduced.

In the above embodiment, although each electric wire is press-connected to the terminal, the terminals are not limited to the press-connecting type, and the above embodiments can be applied to the case where each electric wire is clamped and connected to a crimp-type terminal. In the above embodiments, although the plurality of juxtaposed terminal chambers are formed in the inner housing (for fitting into the outer housing), and are arranged in a row in the horizontal direction, a plurality of rows of terminal chambers may be formed and arranged in the vertical direction. The rubber plugs can be made of any suitable material having elasticity similar to that of rubber, and for example, the rubber plugs can be made of a soft synthetic resin having elasticity.

What is claimed is:

1. A waterproof connector comprising:

a waterproof rubber plug having a through hole through which an electric wire is inserted;

a terminal to which the electric wire is connected;

an inner housing having a terminal chamber for accommodating the terminal;

an outer housing having sidewalls and a rear wall for defining a chamber into which the inner housing is fitted, the rear wall including a through hole, through which the electric wire is inserted, so as to face the terminal chamber when the inner housing is inserted into the chamber of the outer housing;

a recess formed on the rear wall so as to communicate with the through hole and opened to the outside of the outer housing; and a press-fitting member engaged with the outer housing while press-fitting the rubber plug into the recess after the inner housing is completely fitted into the chamber of the outer housing, thereby sealing the electric wire and the terminal chamber, wherein the press-fitting member is a leverage member, one end of which is pivotably supported on the outer housing, and the other end of which is engaged with the outer housing while press-fitting the rubber plug into the recess by the leverage action thereof.

2. The waterproof connector as set forth in claim 1, wherein a hook member is formed an inner wall of the recess for retaining the rubber plug inside of the recess.

3. A method for assembling the waterproof connector as set forth in claim 1, comprising the steps of:

passing the electric wire through the through bole of the rubber plug;

passing the electric wire through the through hole on the rear wall of the outer housing while staying the rubber plug outside of the outer housing;

connecting the electric wire to the terminal;

fitting the terminal into the terminal chamber of the inner housing;

fitting the inner housing into the chamber of the outer housing;

fitting the rubber plug into the recess of the outer housing by the leverage action of the press-fitting member; and engaging the press-fitting member with the outer housing.

* * * * *